US006213619B1

(12) United States Patent
Yu

(10) Patent No.: US 6,213,619 B1
(45) **Date of Patent: *Apr. 10, 2001**

(54) WRIST MOUNTED LIGHT

(76) Inventor: Sun Yu, 2850 Coolidge Hwy., Berkley, MI (US) 48072

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/170,444

(22) Filed: Oct. 13, 1998

Related U.S. Application Data

(60) Provisional application No. 60/061,956, filed on Oct. 14, 1997.

(51) Int. Cl.[7] ..... F21V 21/08

(52) U.S. Cl. ..... 362/103; 362/191; 362/382; 362/396; 116/DIG. 44; 340/326

(58) Field of Search ..... 362/103, 191, 362/382, 396; 340/326; 341/22; 116/DIG. 44

(56) References Cited

U.S. PATENT DOCUMENTS

| | | | | |
|---|---|---|---|---|
| D. 344,411 | | 2/1994 | Henry et al. | D3/229 |
| 4,788,631 | | 11/1988 | Fuller | 362/103 |
| 4,910,652 | | 3/1990 | Rhine | 362/234 |
| 5,154,506 | * | 10/1992 | Leard | 362/103 |
| 5,191,197 | | 3/1993 | Metlitsky et al. | 235/482 |
| 5,568,971 | | 10/1996 | Jewell | 362/103 |
| 5,601,356 | | 2/1997 | McWilliams | 362/103 |
| 5,764,164 | * | 6/1998 | Cartabiano et al. | 341/22 |
| 5,859,582 | * | 1/1999 | Yuen | 340/326 |

* cited by examiner

*Primary Examiner*—Cassandra Spyreu
*Assistant Examiner*—Craig Curtis
(74) *Attorney, Agent, or Firm*—Gifford, Krass, Groh, Sprinkle, Anderson & Citkowski, P.C.

(57) ABSTRACT

A flashlight assembly is mountable onto a user's wrist to provide a light source which is pivotable in two planes of motion. The assembly includes a housing which is pivotably mounted on a wrist band. The housing includes a light source which is pivotably mounted thereto.

8 Claims, 3 Drawing Sheets

Figure 6:
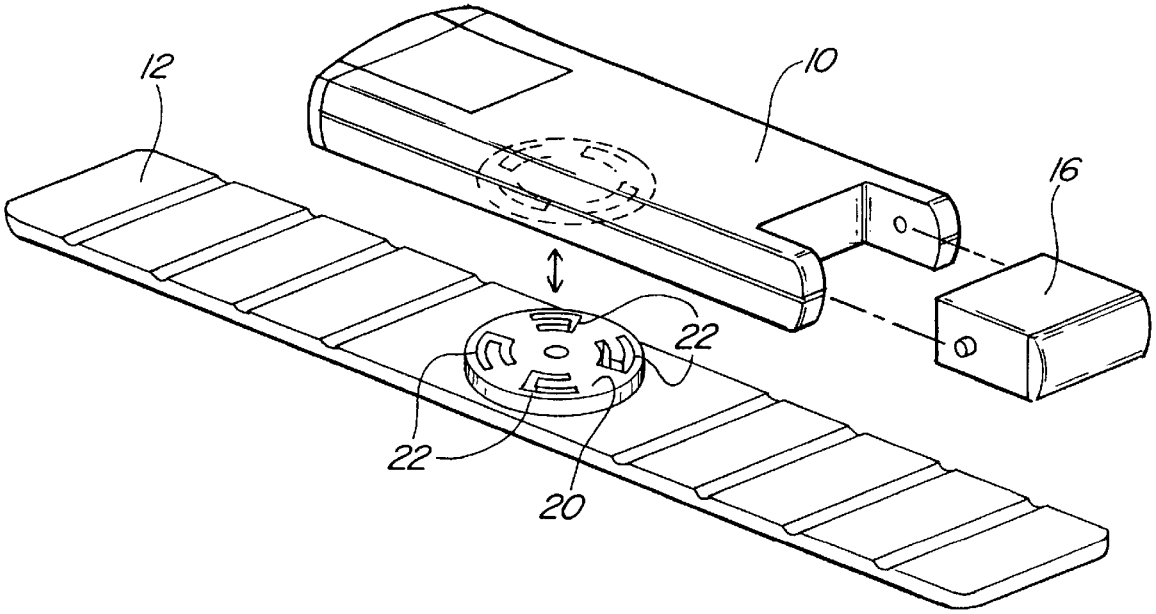

FIG-1
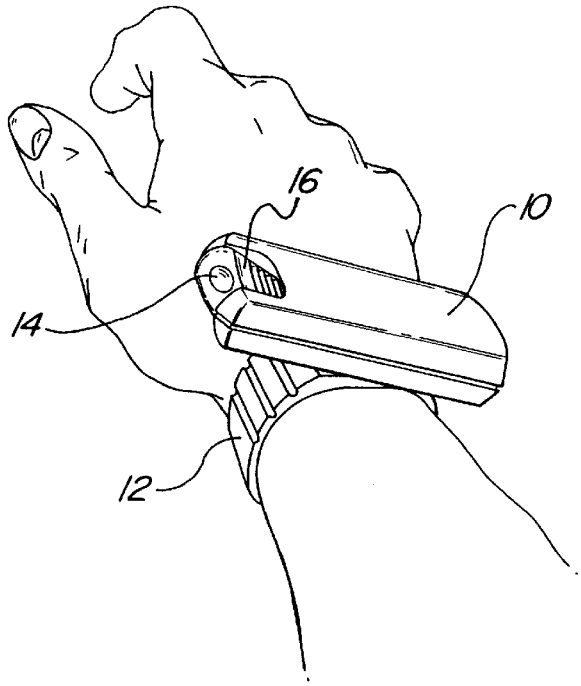
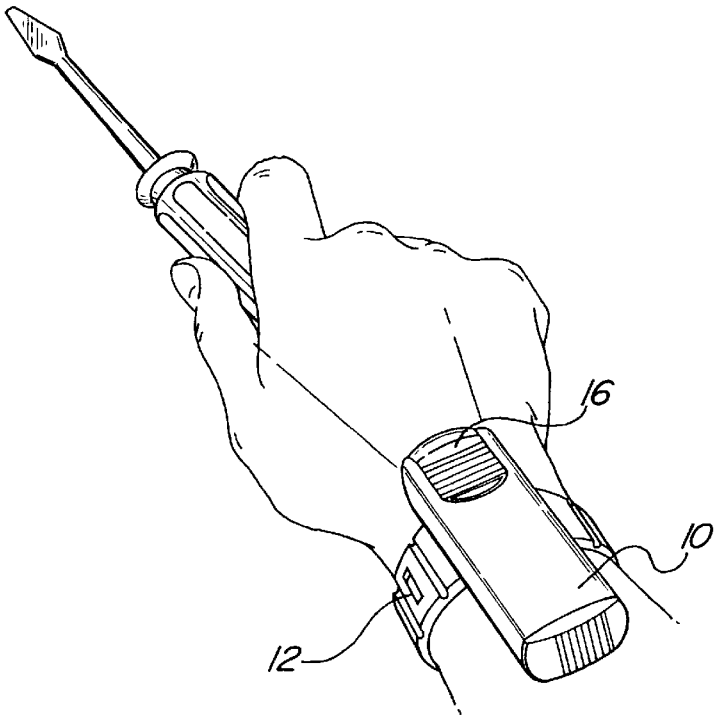
FIG-2
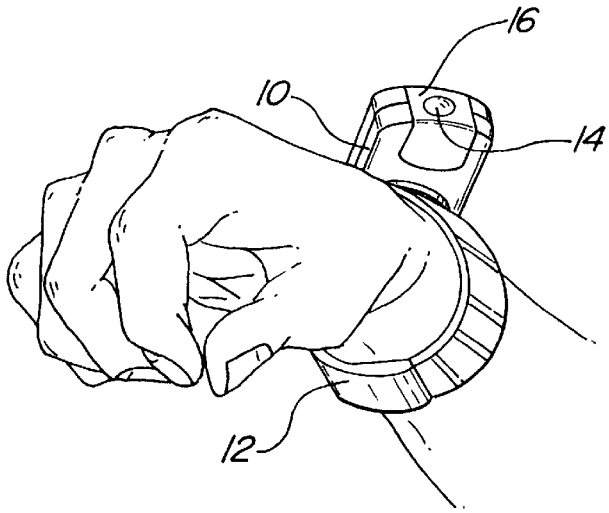
FIG-3

FIG-4
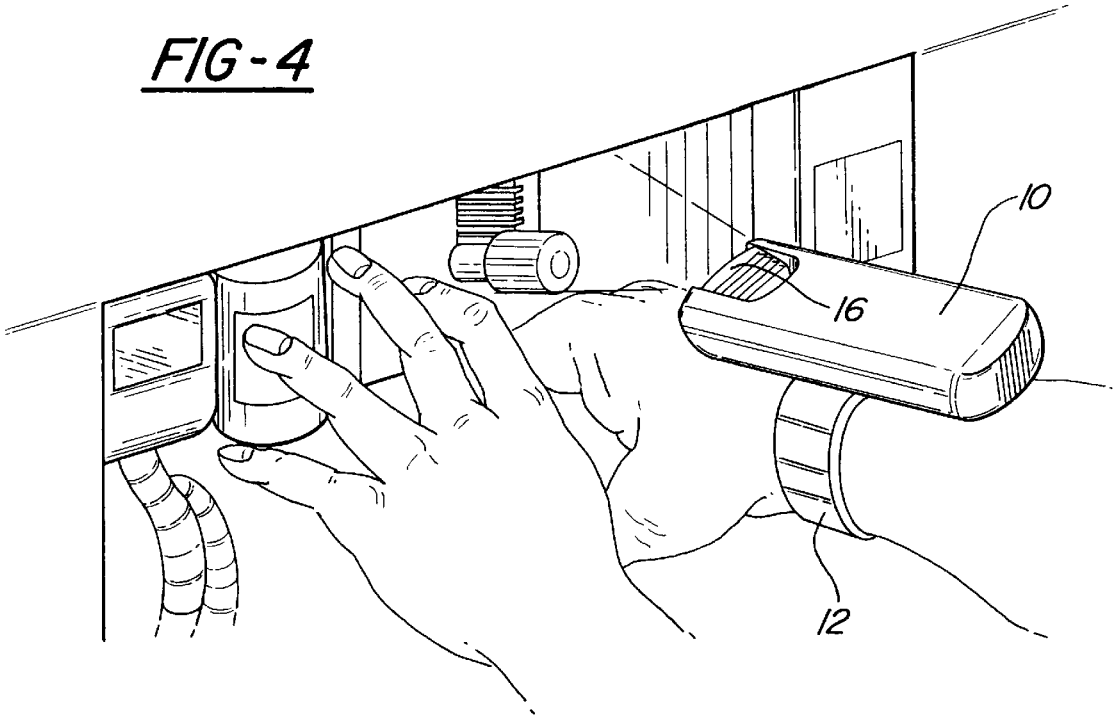
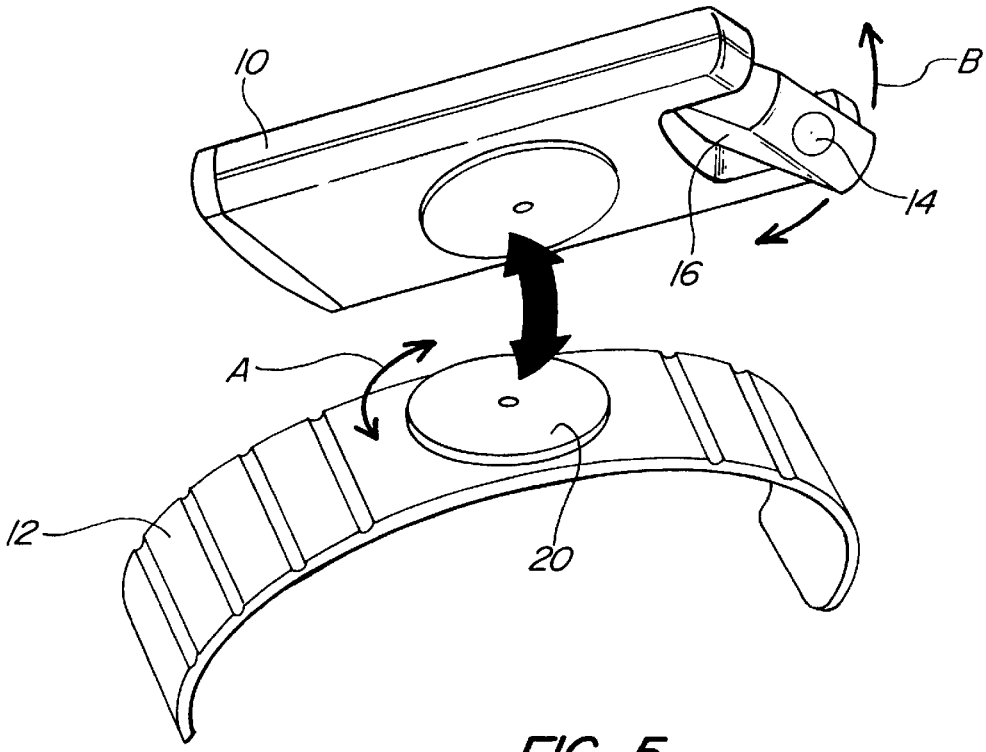
FIG-5

WRIST MOUNTED LIGHT

RELATED APPLICATION

This application claims priority of provisional Patent Application Ser. No. 60/061,956 filed Oct. 14, 1997.

FIELD OF THE INVENTION

This invention relates generally to flashlights. More specifically, the invention relates to a wrist mounted flashlight.

DESCRIPTION OF THE INVENTION

This invention relates to a flashlight which is supported on the wrist or forearm of a wearer, most preferably by an adjustable band. In particular embodiments, the flashlight is pivotably supported so that its beam may be directed independently of the orientation of the user's hand. In some instances, the flashlight may pivot on one axis, while in other instances, it may pivot on two axes, to provide full adjustment. In other embodiments of the invention, further features are combined with the flashlight. For example, a laser pointing device may also be included in the wrist mounted unit as may be a signal or indicator light, and a clock or timer.

FIG. 1 shows one embodiment of wrist mounted flashlight structured in accord with the principles of the present invention. As shown in FIG. 1, a flashlight 10 is mounted on to a user's hand by means of a wristband 12. The band 12 is of the type typically employed for fastening a watch, or the like, to a user's wrist, and may be fastened by a buckle or by hook and loop material, or it may be an expansion band, or the like. In one preferred embodiment, the flashlight 10 is mounted to the band 12 so as to be pivotable thereupon as is further illustrated in FIGS. 2, 3 and 4. In the embodiment shown in FIGS. 1–4, the flashlight 10 further includes a light bulb 14 which is supported in a reflector housing 16; and this reflector housing 16 is also pivotable within the body of the flashlight. This allows for further adjustment of the light beam.

Referring now to FIG. 5, there is shown a schematic, exploded, depiction of the wrist mounted flashlight assembly of FIGS. 1–4. As shown in FIG. 5, the flashlight 10 is pivotably supported upon the wrist band 12 through a rotatable support 20 providing for pivoting in a first plane as indicated by arrow A. As is further noted in FIG. 5, the reflector housing 16 of the flashlight 10 is also pivotable upon the flashlight body so as to provide for pivoting in a second plane as indicated by arrow B which is perpendicular to the first plane A. In this manner, the light from the bulb 14 may be directed, independently of the location of the arm of the person using the flashlight assembly.

Referring now to FIG. 6, there is shown another depiction of the foregoing embodiment of the flashlight assembly, and as is shown herein, the pivotable connection 20 between the flashlight 10 and wristband 12 includes a series of detent members 22 therein. These detent members 22 provide for click stops which aid in the positioning of the flashlight body 10.

It is to be understood that in accord with the present invention, a wrist mounted flashlight may include means for providing or pivoting about one or more axes, or it may comprise a fixed flashlight which is not pivotable. Also, other embodiments of the flashlight, different from that shown in these Figures may be supported upon the user's wrist.

Figure 7:
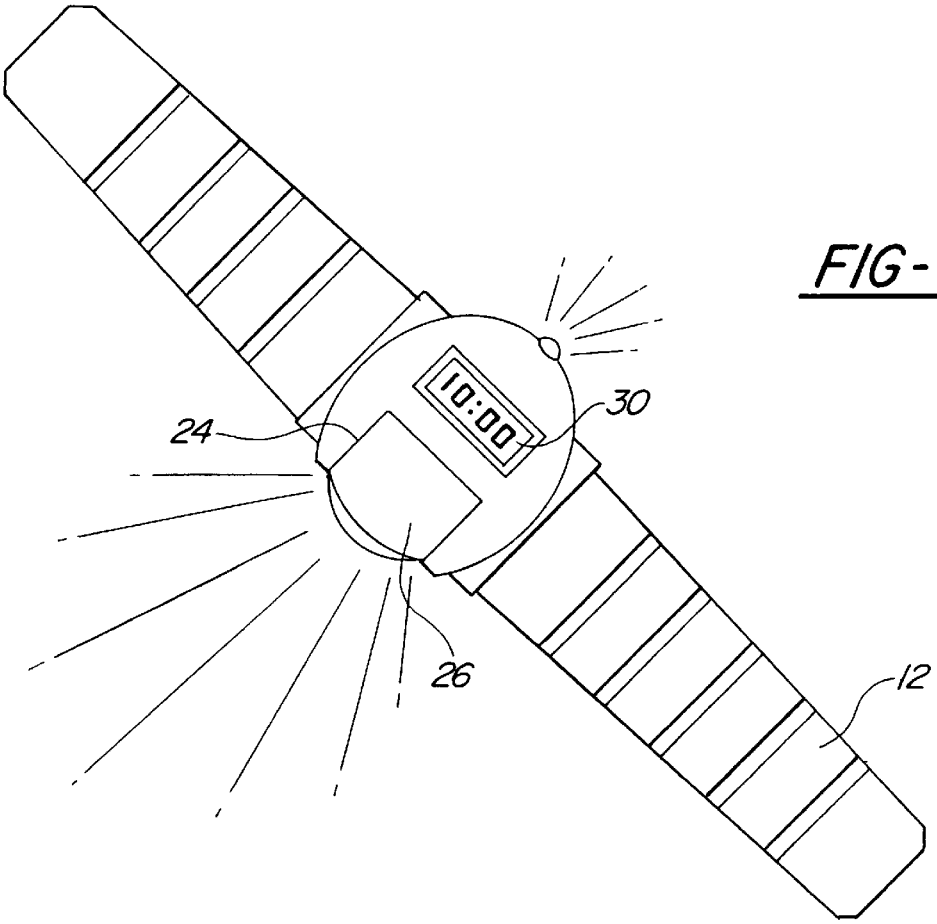

Referring now to FIG. 7, there is shown yet another embodiment of a wrist mounted flashlight structured in accord with the present invention. The FIG. 7 embodiment shows a wristband 12, as previously described, having a multi-function base 24 retained thereupon. The base includes a flashlight portion 26; and the flashlight portion 26 may be pivotably mounted upon the base 24, or it may be simply mounted thereupon. The FIG. 7 embodiment further incudes a second light source 28 thereupon. This second light source 28 may comprise a light emitting diode, which may be used as a safety signal, for joggers or children. Alternatively, the secondary light source 28 may be a laser diode pointing device, and it may be oriented so that the beam therefrom will point in a direction corresponding to the user's hand. This embodiment may be employed by teachers and other public speakers. As further illustrated in FIG. 7, the base member 24 may also support a clock or timer 30 operable to tell the time of day, or to time an event, such as the length of a speech or presentation. Yet other features such as calculators, optical remote control units, sound recording devices and the like may be similarly included in combination with the wrist mounted light source.

It is to be understood that still other embodiments of the present invention may be implemented in view of the teaching presented herein. The foregoing drawings, discussion and description are illustrative of particular embodiments of the present invention, but are not meant to be limitations upon the practice thereof. It is the following claims, including all equivalents, which define the scope of the invention.

What is claimed is:

1. A wrist mounted light comprising:

a wrist band configured to be fixedly retained upon the wrist of a wearer;

a self-powered light source, fixedly mounted to said wrist band so as to be pivotable in two planes of motion relative to said wrist band, said light source comprising:

a body portion which is pivotally attached to said wrist band by a rotatable support which is operable to allow the body portion to rotate only in a first plane relative to said wrist band; and a reflector housing which is configured to support and retain a light and which is pivotably attached to said body portion so as to be rotatable only in a second plane which is perpendicular to said first plane; whereby said light source is rigidly supported on a wrist, and is pivotable in two planes of motion relative to said wrist.

2. The wrist mounted light of claim 1, wherein said rotatable support is operable to allow the body portion to rotate only in a first plane, which is tangent to the circumference of the wrist band.

3. The wrist mounted light of claim 1, further including detent means associated with said light source for controlling the pivoting of said light source.

4. The wrist mounted light of claim 1, further including timekeeping means associated therewith.

5. The wrist mounted light of claim 1, further including a second light associated therewith.

6. The wrist mounted light of claim 1, further including a recorder associated therewith.

7. The wrist mounted light of claim 1, further including a signaling device associated therewith.

8. The wrist mounted light of claim 1, further including a remote control device associated therewith.

* * * * *